US006674184B2

(12) United States Patent
Donnerdal et al.

(10) Patent No.: US 6,674,184 B2
(45) Date of Patent: Jan. 6, 2004

(54) STOP DEVICE

(75) Inventors: Ove Donnerdal, Sävedalen (SE); Magnus Söderqvist, Mölndal (SE)

(73) Assignee: Aktiebolaget Electrolux (publ), Stockholm (SE)

( * ) Notice: Subject to any disclaimer, the term of this patent is extended or adjusted under 35 U.S.C. 154(b) by 458 days.

(21) Appl. No.: 09/816,142

(22) Filed: Mar. 26, 2001

(65) Prior Publication Data

US 2001/0028199 A1 Oct. 11, 2001

(30) Foreign Application Priority Data

Apr. 5, 2000 (SE) ..... 0001225

(51) Int. Cl.[7] ..... H02H 1/00; F02N 17/00
(52) U.S. Cl. ..... 307/326; 123/179.5
(58) Field of Search ..... 307/326; 123/335, 123/179.1–179.9

(56) References Cited

U.S. PATENT DOCUMENTS 3,851,126 A 11/1974 Keller ..... 200/60
4,919,091 A 4/1990 Wissmann et al. ..... 123/179
5,209,196 A * 5/1993 Nickel et al. ..... 123/179.5
5,485,814 A * 1/1996 Tuggle et al. ..... 123/179.5

FOREIGN PATENT DOCUMENTS

DE 38 21 958 1/1990 ..... B60R/16/02

* cited by examiner

*Primary Examiner*—Gregory J. Toatley, Jr.
(74) *Attorney, Agent, or Firm*—Michael D. Bednarek; Shaw Pittman LLP

(57) ABSTRACT

The invention relates to a gasoline motor powered, hand-operated working machine, which is stopped by short-circuiting an electric circuit (70), said stop device being designed in the form of an electric switch comprising a stop control (11), which can be moved manually between two end positions; a drive position for start of the motor and for motion of the motor, in which drive position said circuit is not short-circuited, and a fixed stop position in which the circuit is short-circuited and the stop control is locked. The characteristic features are that the electric circuit is short-circuited also in a non-locked intermediate position (II) of the stop control, which the stop control must pass, if it is brought all the way from the drive position (I) to the fixed stop position (III), and that a spring (60) is provided to return the stop control to the drive position, if the stop control is moved from the drive position to said intermediate position and then released, implying that the intermediate position is a re-springing stop position of the stop control.

11 Claims, 5 Drawing Sheets

STOP DEVICE

TECHNICAL FIELD

The invention concerns a stop device for a gasoline motor powered, hand-operated working machine, which is stopped by short-circuiting an electric circuit, said stop device being designed in the form of en electric switch comprising a stop control, which can be moved manually between two end positions; a drive position for start of the motor and for motion of the motor, in which drive position said circuit is not short-circuited, and a fixed stop position in which the circuit is short-circuited and the stop control is locked.

The invention also concerns the gasoline motor powered, hand-operated working machine which is provided with the stop device.

BACKGROUND OF THE INVENTION

According to current safety regulations, the stop control of gasoline motor powered, hand-operated working machines must have a fixed stop position, which shall be possible to be adopted therein that the operator moves the stop control from the drive position to the fixed stop position through a single, uninterrupted movement. The reason for this regulation is that the machine safely shall be able to be stopped in an emergency situation. But also in case of occasional stops, e.g. for periods of rest, refuelling etc., the stop control of existing machines need to be moved to the fixed end stop in order to stop the motor. Before the machine can be restarted, the stop control must be brought back to the drive position. It frequently happens that the operator forgets to do that and repeatedly pulls the starter rope until he becomes aware of his mistake, and this is particularly true when existing stop controls have the shape of a knob or slide which does not provide any readily visible signals. Meanwhile the engine often has become "wet", which makes the start difficult.

BRIEF DISCLOSURE OF THE INVENTION

It is the purpose of the invention to address the above mentioned problem. According to a first aspect of the invention, which concerns the stop device which is first mentioned in the preamble, the invention is characterised in that the electric circuit is short-circuited also in a non-locked intermediate position of the stop control, which the stop control must pass, if it is brought all the way from the drive position to the fixed stop position, and that a spring is provided to return the stop control to the drive position, if the stop control is moved from the drive position to said intermediate position and then released, implying that the intermediate position is a re-springing stop position of the stop control. According to this aspect of the invention, the operator thus can choose either to move the stop control from the drive position beyond the intermediate position and further on to the fixed stop position, a possibility which can be used in emergency situations, or e.g. when the job has been finished for the day, or to move the stop control only to the intermediate position so that the machine is stopped by short-circuiting the electric circuit, whereafter the stop control is released and is automatically caused to spring back to the drive position. In the latter case, the operator need not think of positioning the stop control in a proper position before start.

According to another aspect of the invention, the stop device is characterised in that it is designed as a toggle switch including a rocker which is turnable about an axis of rotation, that the rocker has a first, outer lever with a grip member and a second, inner lever, that the rocker is biased by the force of the spring which acts against said inner lever, and that the movable contact member is provided to be conveyed by the inner lever as the rocker is being turned against said re-springing and/or fixed position of contact.

According to still another aspect of the invention, the stop device is characterised therein that it is designed as a toggle switch, said stop control forming a rocker, which includes a first lever which is turnable about an axis of rotation between said drive position and said fixed stop position, that said first lever is substantially turned into a wall of the working machine in the drive position of the machine, when the stop device is mounted on a working machine, and that it in the fixed drive position substantially is turned out from said wall. According to this aspect of the invention, the turned out lever including the grip member in the fixed stop position acts as a readily observable signal to the operator that the stop device has adopted its fixed stop position and that the machine therefore cannot be started. This signal is enhanced if the stop control including the grip member has a bright signal-colour. The turned out position of the stop control in other words gives the operator an impulse to turn in the control with said outer lever as an initial measurement before start.

According to yet another aspect of the invention, which relates to the gasoline motor powered, hand-operated working machine, the working machine is of the well known type which includes a rear operating handle with a starter throttle control on one side of the operating handle, which starter throttle control must be pressed into the operating handle before start. The characteristic features of the invention according to this aspect of the invention are that the stop device is designed as a toggle switch on a wall of the machine at the side of the starter throttle control and that a first, outer lever of a rocker of the toggle switch, in the fixed stop position, is substantially turned out from the wall of the machine at the side of the operating handle in a direction towards the starter throttle control to a position outside of the starter throttle control, such that the starter throttle control is made difficult to access by the machine operator, while said lever in the drive position is turned away from the starter throttle control and substantially into said wall, such that the starter throttle control is made easy to access and the rocker is protected, so that the engine is not unintentionally switched off during operation.

Said aspects of the invention can be combined with one another but in some respects be employed independent of each other.

Further aspects and characteristic features of the invention will be apparent from the appending patent claims and from the following detailed description of the invention.

BRIEF DESCRIPTION OF DRAWINGS

In the following detailed description of the invention, reference will be made to the accompanying drawings, in which.

DETAILED DESCRIPTION OF THE INVENTION

Figure 1:
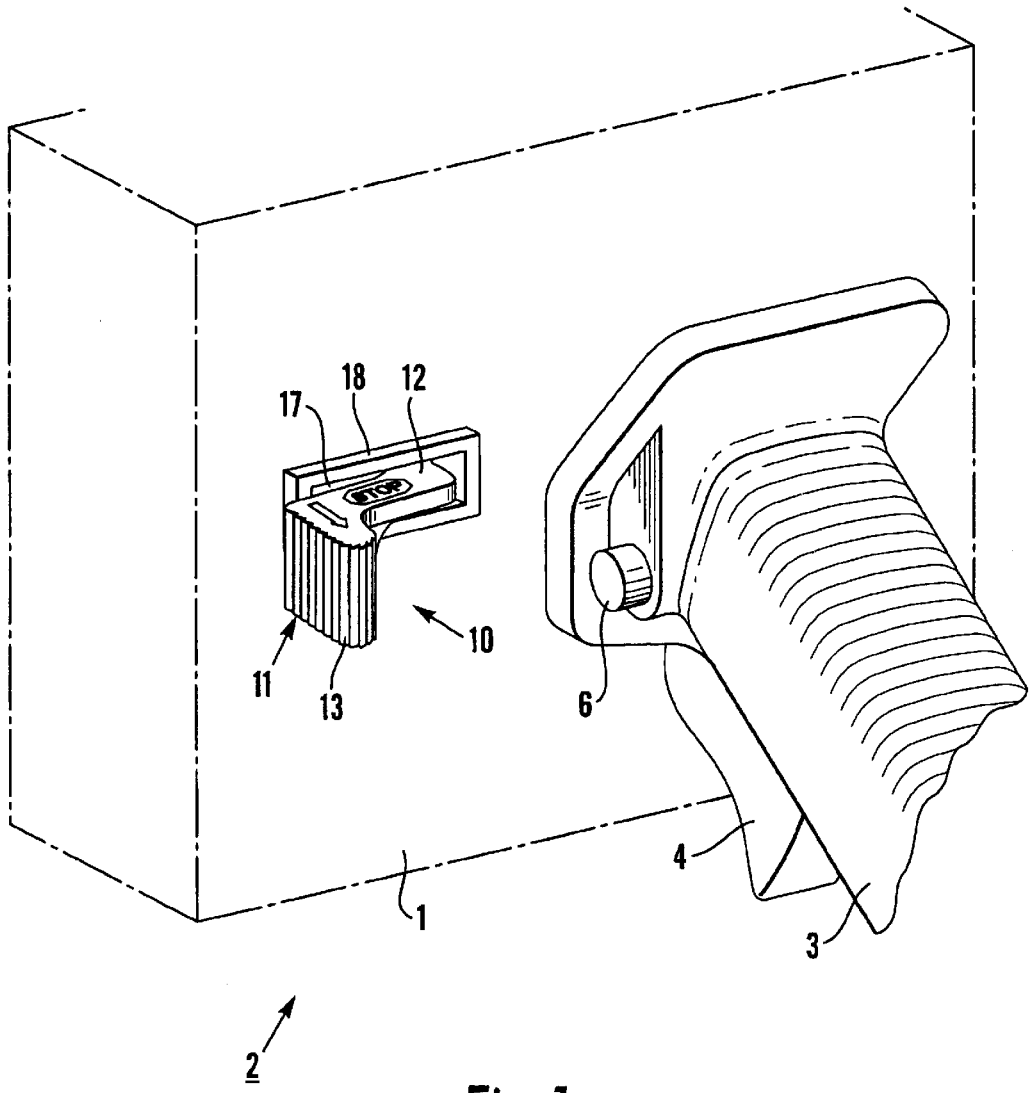
FIG. 1 shows a conceivable application of the invention in a perspective view of a schematically shown portion of a machine comprising a stop control in its drive position.
Figure 2:
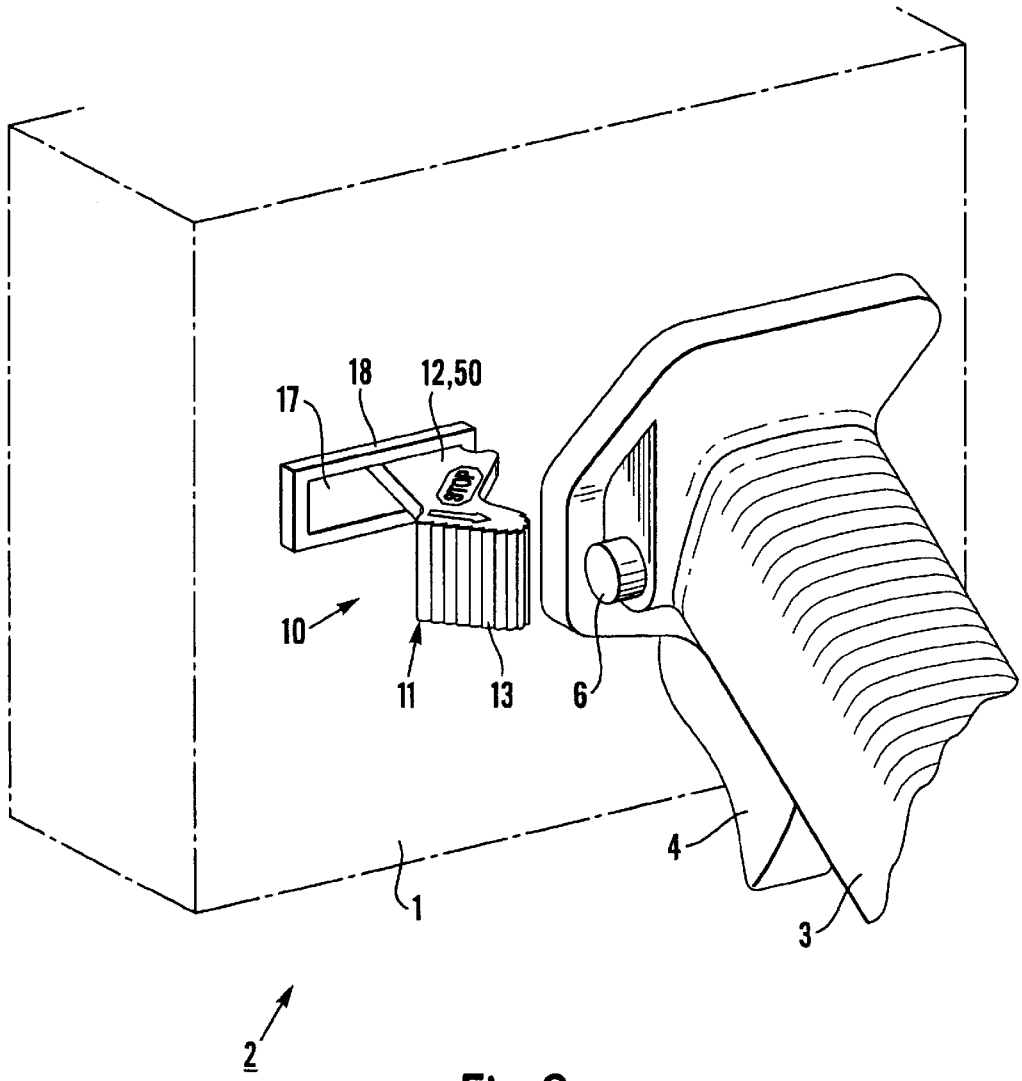
FIG. 2 shows the same machine with the stop control in a fixed stop position.

With reference first to FIG. 1 and FIG. 2, there is schematically shown the rear wall 1 of a motor housing 2 of a gasoline motor powered, portable and hand-operated working machine, more particularly a cutter. An operating handle, intended to be gripped by the operator's right hand, is designated 3. In connection with the operating handle there is in a conventional way a throttle control 4 under the operating handle, an idling catch 5 on the upper side of the operating handle, and a starter throttle control 6 on the left hand side of the operating handle 3. To make it possible to start the motor, the starter throttle control 6 in a manner known per se first must be pressed into the operating handle 3 by the operator. This is normally made by the operator's right hand thumb.

On the rear side 1 of the motor housing, to the left of the operating handle 3 and at level with the starter throttle control 6 there is provided a stop device 10 for the engine. The stop device 10 comprises a stop control 11, which is designed with a rocker 12 with a finger grip 13. The stop control 11 is operated by turning the rocker 12 by means of the finger grip 13 about a vertical axis of rotation 15, FIG. 3.

When the rocker 12 with the finger grip 13 is in the drive position of the stop control 11, the rocker 12 is substantially turned in into and is protected in the rear wall 1 of the motor housing 2, so that only the finger grip 13 projects to any essential degree from the motor housing wall. The starter throttle control 6 in this position is easy to access by the operator and allows start of the engine, FIG. 1. When the stopper control 11 with the rocker 12 and the finger grip 13 is in the fixed stop position, FIG. 2, the rocker with an outer lever 50, which has the finger grip 13 in the outer end thereof, on the other hand is turned out from the motor housing wall 1, so that the finger grip 13 prevents the operator to access the starter throttle control 6 with his thumb. At least this requires so much trouble that the operator becomes aware of the fact that the stop device is in its fixed stop position. The operator therefore is more or less forced to move the stop control 11 from its fixed stop position, FIG. 2, to the drive position, FIG. 1, before he can press in the starter throttle control 6 and start the engine. At that type of machines where the motor stop device is located, or can be located, at the rear side of the motor housing adjacent to the starter throttle control 6, the described arrangement, according to one aspect of the invention, thus is a very efficient means for preventing the operator to start the engine with the stop device in the stop position, but also if the stop device 10 has another location than adjacent to the starter throttle control 6, the projecting position of the rocker 12, and particularly the position of the projecting finger grip 13, is a readily visible indication that the stop device is in its fixed stop position, which can prevent many attempts to start the engine in that position. Moreover, the signal action of the finger grip 13 in the turned out position can be enhanced, if it has a different colour than the wall 1.

According to the embodiment the stop device 10 thus is designed to prevent attempts to start in the fixed stop position independent on mounting location; on one hand therein that the rocker with its finger grip 13 projects pronouncedly in the stop position, and on the other hand due the "interior" design of the device 10 which shall be described in the following.

FIGS. 3–6 show more in detail how the stop device 10 is designed according to a preferred embodiment. The stop device 10 can be mounted on the machine on and in the rear wall 1 of the motor housing 2, as has been described above, wherein, in combination with the starter throttle control 6, there is achieved the specific effect which also has been described above, but the stop device 10 can also be mounted at any other location on the machine, e.g. on the side of the machine in a manner which is conventional, as has been mentioned in the foregoing, as will be described below.

Whether the stop device 10 is mounted on the rear side 1 of the motor housing or at any other location of the machine, the stop device 10 preferably is mounted such that the axis of rotation 15 is vertical in the normal working state of the machine. The denominations of the various parts of the stop device are based on that orientation, although also other orientations of the stop device 10 in principle can be conceived.

The stop device 10 consists of a toggle switch having a breaker housing 17 of electrically insulating plastic material. A circumferential frame, which constitutes an integrated part of the breaker housing 17, is denoted 18. The frame 18 abuts the exterior of the machine, as is shown in FIG. 1 and FIG. 2, while the rest of the breaker housing 17 is recessed in the machine wall. At the interior of the frame 18, the breaker housing 17 has an upper wall 19, a lower wall 20 with a screw hole 21 for assembling the stop device 10 with the machine, a left hand wall 22, a right hand wall 23, and an inner wall portion 24, which only partly covers the interior of the breaker housing 17.

In the breaker housing 17 there is provided a fixed contact member 27, which has the shape of a bent piece of metal sheet. One end 28 of the metal sheet (the fixed contact member) 27 extends through an opening 30 in a projection 31 of the breaker housing 17 at level with said inner wall portion 24. Inside of the opening 30 the sheet extends along the front wall 22 of the breaker housing, through an opening 32, FIG. 4, in the left hand wall 22, and then forms a sharp bend 33 (dotted in FIG. 5), and further a circular arc 34. Within the region of the circular arc 34, one edge of the metal sheet 27 abuts the lower wall 20 of the breaker housing 17. The other, free edge of the metal sheet 27 forms a cam curve 26. The other end 29 of the metal sheet/the fixed contact member 27 is secured in the lower wall 20 of the breaker housing.

Figure 6:
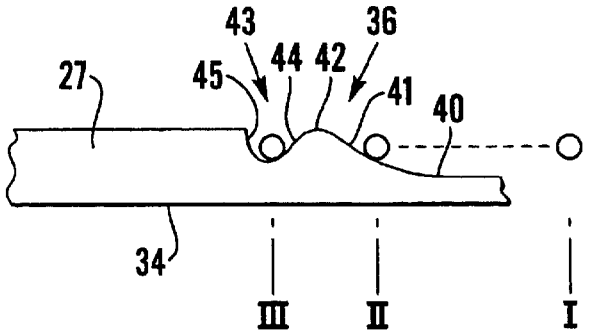
FIG. 6 schematically illustrates the cooperation between a fixed and a movable contact member included in the stop device.

FIG. 6 shows the circular arc shaped portion of the fixed contact member (metal sheet) 27 in a conceived flattened shape. On the cam curve 36 there is an initial portion 40, then an upwardly inclined portion 41, a crest 42, and after the crest 42 a recess 43 having a second, downwardly sloping portion 44 between said crest and the bottom of the recess. The opposite side 45 of the recess 43 rises steeply.

The stop control is part of a rocker 12, designed as a double armed lever, which is turnable about the vertical axis of rotation 15. More particularly, the stop control forms the main part of a first or outer lever arm, which is denoted 50. The finger grip 13 constitutes the outermost part of the outer lever arm 50. The second or inner lever arm is denoted 51. In the drive position of the stop control the outer lever arm 50 is recessed in the breaker house 17, as is shown in FIG. 1, except the finger grip 13 and a portion 52 at the side thereof, on which the sign STOP is provided. In the fixed stop position, on the other hand, the lever arm 50 with the finger grip 13 is turned out from the breaker housing and out from the motor housing wall 1, FIG. 2.

The inner lever arm 51 of the rocker 12 is designed as a sector of a circle. In its right hand end said sector of a circle has a protrusion 53, FIG. 3, directed towards the lower wall 20 of the breaker housing.

According to the embodiment, the stop device (toggle switch) 10 comprises a movable contact member, which can be moved by means of the stop control 13, wherein the fixed contact member (metal sheet) 27 has a first and a second contact seat provided for the movable contact member. The first contact seat, which the movable contact member adopts in the fixed stop position of the stop control, is said recess 43 in the metal sheet, while the second contact seat, which corresponds to the intermediate position of the stop control, does not have any holding means for retaining the movable contact member but consists of the upwardly inclined portion 41 of the metal sheet.

A metal spring, more particularly a helical torsion spring, is denoted 60. Said metal spring 60 has several functions. Firstly, one projecting end 61 of the spring forms said movable contact member therein that it is pressed by the spring against the protrusion 53 on the inner lever arm 51 and is moved by said protrusion as the rocker 12 is turned to stop positions. Secondly, the whole of the metal spring 60 as well as the stationary contact member (metal sheet) 27 form part of the short-circuiting circuit that shall short-circuit the electric circuit 70, FIG. 3, as mentioned in the preamble. The stationary end 62 of the metal spring 60, which extends through the lower wall 20 and/or the inner wall 24 therefore is connected to the metal motor housing or motor block of the working machine, which represents earth and constitutes one pole of the electric circuit 70. Thirdly, the spring 60 serves to return the stop control 11 to drive position from said intermediate position by biasing the protrusion 53 on the inner lever arm 51 of rocker 12. Fourthly, the movable end 61 of the spring has a locking function together with the metal sheet 27.

The first end 28 of the stationary contact member (metal sheet) 27 is connected to the second pole of the electric circuit 70. More particularly, the stop device 10 is provided to short-circuit the low voltage side (primary side) 71 of the ignition module of the engine.

Figure 3:
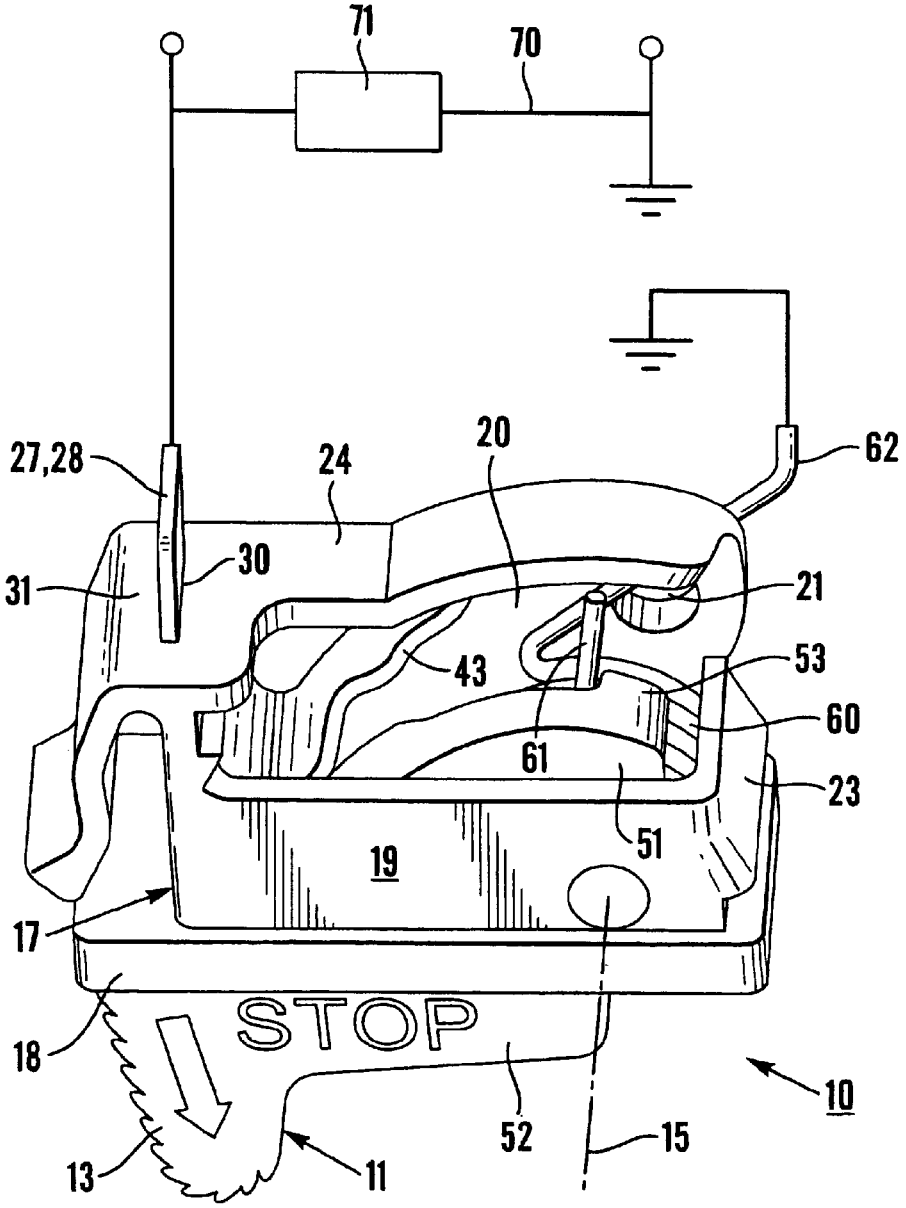
FIG. 3 shows a stop device in a perspective view with the stop control in the drive position.
Figure 4:
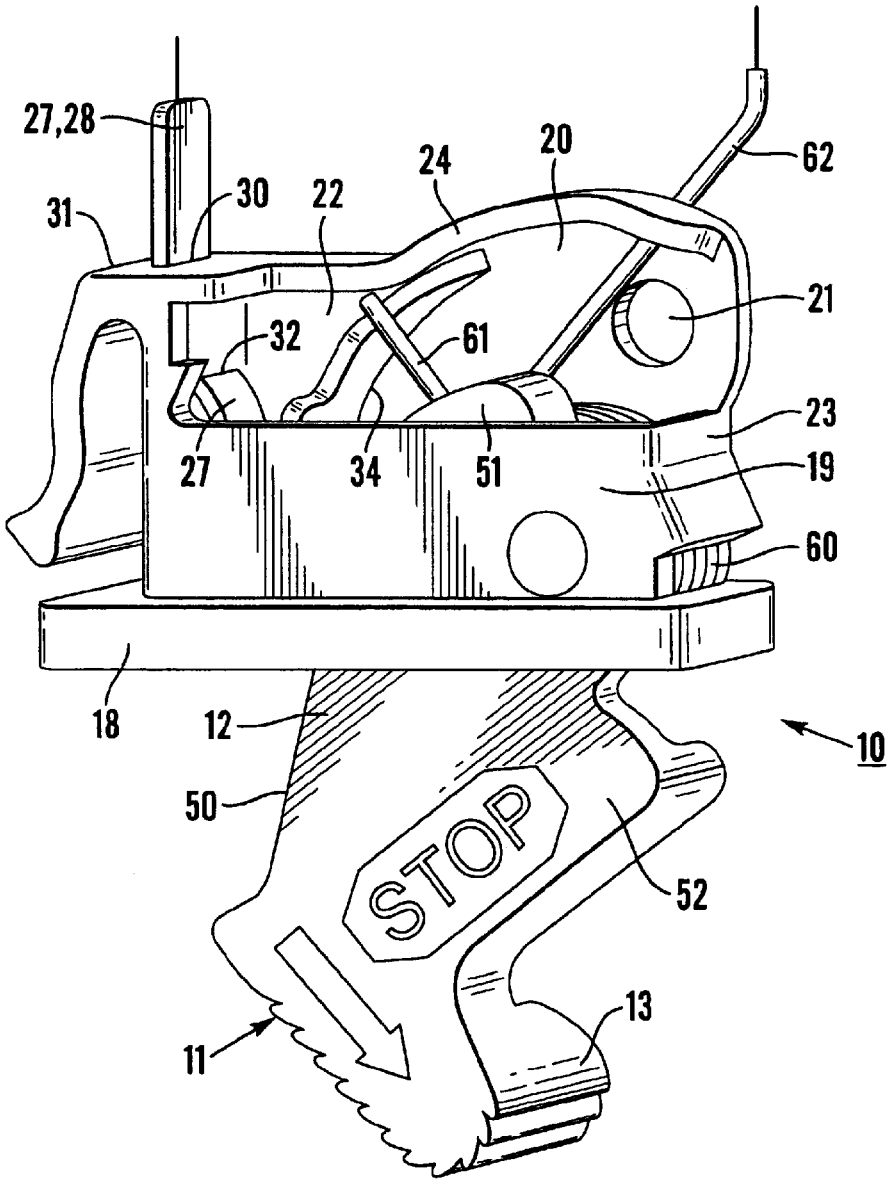
FIG. 4 shows the stop device with the stop control in a re-springing stop position.
Figure 5:
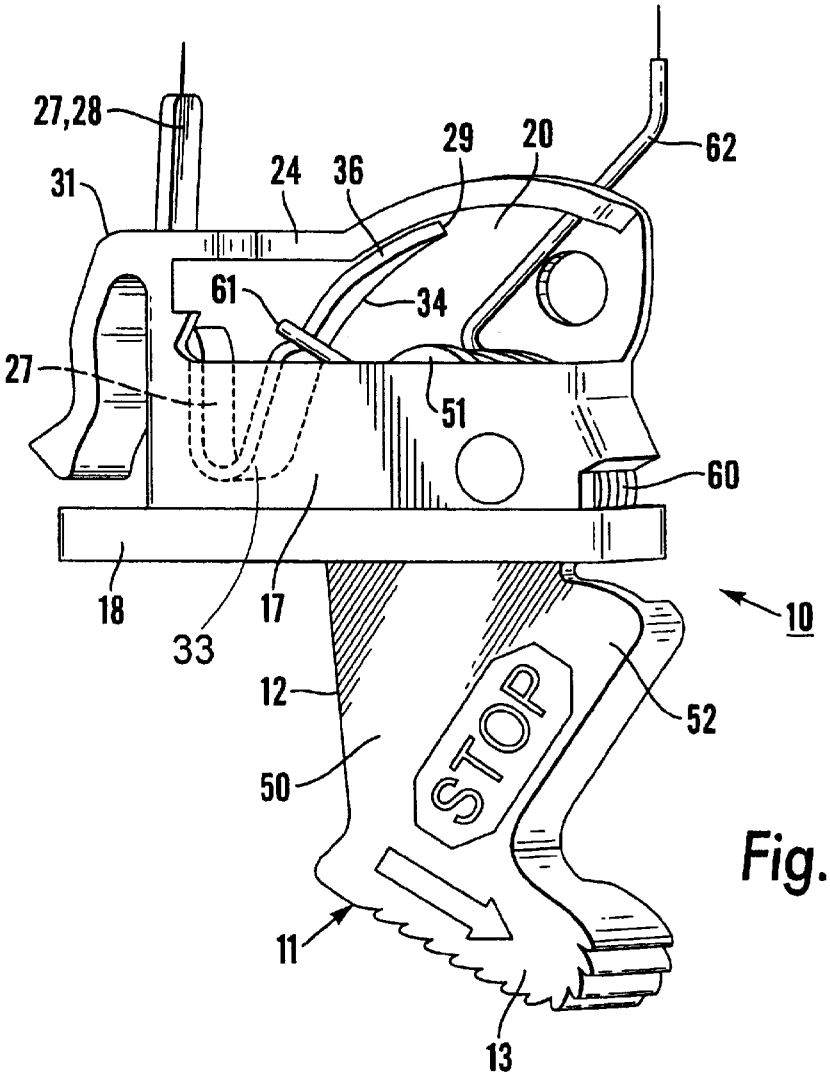
FIG. 5 shows the stop device with the stop control in a fixed stop position.

The described device functions in the following way. It is assumed that the initial condition is that which is shown in FIG. 1 and FIG. 3, i.e. with the stop control in the drive position. The switch then is shut off, i.e. the short-circuiting circuit is not closed. The movable part 61 of the metal spring 60 then is in position I in FIG. 6. In order to stop the engine according to the normal alternative, the operator turns the rocker 12 about its axis of rotation 15 by means of the finger grip 13, wherein the rocker by means of the protrusion 53 on the inner lever arm 51 brings the movable end 61 of the metal spring into contact with metal sheet 27 in the region of the sloping portion 41 of the cam curve 36, position II in FIG. 6. Herein the short-circuiting circuit is closed and the engine stops. After a short holding time in that position, as is shown in FIG. 4, representing said intermediate position, the operator can release the finger grip 13 causing the rocker 12 and hence the stop control 11 to return to the drive position, FIG. 3, by means of the spring 60. If the holding time in the intermediate position, position II, is too short and if there is a substantial mass rotating in the machine, there is a risk that the engine may self-start when the stop control is returned to drive position. If that would occur in a normal situation, the operator repeats the stop procedure to bring the engine to stop. In an emergency situation, or if the operator from any other reason wishes to bring the stop control to the fixed stop position, the operator moves the stop control 12 in a single, uninterrupted movement from drive position, FIG. 3, to the fixed stop position, FIG. 5. During this longer turning movement the movable end 61 of the metal spring 60 is urged to pass the crest 42 of the cam curve 36 in order thereafter to snap-in in the recess/contact seat 43, position III in FIG. 6, in which the end 61 of the spring is locked, so that the movable contact member cannot leave its seat in the recess 43 by the force of the spring only. This position thus represents a fixed stop position, from where the movable contact member only can be removed by the operator's force, directly applied on the stop control 11 in a clockwise direction with reference to FIG. 5.

What is claimed is:

1. Stop device for a gasoline motor powered, hand-operated working machine, which is stopped by short-circuiting an electric circuit (70), said stop device being designed in the form of an electric switch comprising a stop control (11), which can be moved manually between two end positions; a drive position for start of the motor and for motion of the motor, in which drive position said circuit is not short-circuited, and a fixed stop position in which the circuit is short-circuited and the stop control is locked, characterised therein that the electric circuit is short-circuited also in a non-locked intermediate position (II) of the stop control, which the stop control must pass, if it is brought all the way from the drive position (I) to the fixed stop position (III), and that a spring (60) is provided to return the stop control to the drive position, if the stop control is moved from the drive position to said intermediate position and then released, implying that the intermediate position is a re-springing stop position of the stop control.

2. Stop device according to claim 1, characterised therein that the electric switch comprises at least one fixed contact member (27, 28) and one movable contact member (61), that the movable contact member can be moved by means of the stop control, that said at least one fixed contact member has a first (43, III) and a second (41, II) contact seat for the movable contact member, that the first contact seat (43), which the movable contact member (61) adopts in the fixed stop position of the stop control, is designed as a holding means for securing the movable contact member in contact with said fixed contact member, while the second contact member (41), which corresponds to the intermediate position (II) of the stop control is void of any holding means for retaining the movable contact member.

3. Stop device according to claim 1, characterised therein that the spring is made of metal and forms part of the short-circuited circuit.

4. Stop device according to claim 3, characterised therein that the movable contact member (61) forms an integrated, movable part of the spring or is a metallic member connected to the spring.

5. Stop device according to claim 2 characterised therein that said at least one fixed contact member (27) has a slide face designed as a cam curve (36), that the cam curve is provided with said first and second contact seats (41, 43), that the movable contact member is provided to slide against the cam curve as the movable contact member is moved between said first and second contact seats and vice versa, and that the first contact seat consists of a recess (43) in the cam curve provided to accommodate and retain the movable contact member overcoming the force of said spring.

6. Stop device according to claim 1, characterised therein that it is designed as a toggle switch including a rocker (12)

which is turnable about an axis of rotation (15), that the rocker has a first, outer lever (50) with a grip member (13) and a second, inner lever (51), that the rocker is biased by the force of the spring which acts against said inner lever, and that the movable contact member (61) is provided to be conveyed by the inner lever as the rocker is being turned against said re-springing and/or fixed position of contact.

7. Stop device according to claim 1, characterised therein that it is designed as a toggle switch, that the stop control including a grip member (13) is an integrated part of a rocker (12), which includes a first lever (50) which is turnable about an axis of rotation (15) and is substantially turned into a wall (1) of the working machine in the drive position of the machine, when the stop device is mounted on the machine, and that it in the fixed stop position substantially is turned out from said wall.

8. Stop device according to claim 7, characterised therein that the rocker (12) is turnable about said axis of rotation (15) in a breaker housing (17) provided to be mounted turned into a wall of the working machine.

9. Stop device according to claim 8, characterised therein that the rocker consists of a double armed lever, one arm consisting of said first lever arm, the terminating end thereof being provided with a grip member (13), and that the second arm (51) is movable within the breaker housing and provided there to convey the movable contact member, when the engine shall be stopped, and to be conveyed by the spring, respectively, as the start control is returned to drive position.

10. Gasoline motor powered, hand-operated working machine, characterised therein that it is provided with a stop device according to claim 1.

11. Working machine according to claim 10 having a rear operating handle (3) with a starter throttle control (6) on one side of the operating handle, which starter throttle control must be pressed into the operating handle before start, characterised therein that the stop device is designed as a toggle switch on a wall of the machine at the side of the starter throttle control (6) and that a first, outer lever (15) of a rocker of the toggle switch, in the fixed stop position, is substantially turned out from the wall of the machine at the side of the operating handle in a direction towards the starter throttle control to a position outside of the starter throttle control, such that the starter throttle control is made difficult to access by the machine operator, while said lever in the drive position is turned away from the starter throttle control and substantially into said wall, such that the starter throttle control is made easy to access and the rocker is protected.

* * * * *